US005184367A

United States Patent [19]

Haaga

[11] Patent Number: 5,184,367

[45] Date of Patent: Feb. 9, 1993

[54] SWEEPING MACHINE HAVING A HOUSING WHICH COMPRISES TWO SEPARABLE HOUSING PARTS

[75] Inventor: Hermann Haaga, Kirchheim/Teck-Ötlingen, Fed. Rep. of Germany

[73] Assignee: Ing. Haaga Kunststofftechnik GmbH, Fed. Rep. of Germany

[21] Appl. No.: 820,935

[22] Filed: Jan. 15, 1992

[30] Foreign Application Priority Data

Jan. 23, 1991 [DE] Fed. Rep. of Germany ..... 4101889

[51] Int. Cl.[5] ..... A47L 11/22

[52] U.S. Cl. ..... 15/49.1; 15/41.1; 15/79.1; 15/83

[58] Field of Search ..... 15/41.1, 42–46, 15/48, 48.1, 49.1, 52.1, 83, 340.2, 340.4, 79.1, 79.2

[56] References Cited

U.S. PATENT DOCUMENTS 4,084,284 4/1978 Hastings ..... 15/79.2

FOREIGN PATENT DOCUMENTS 0265015 10/1987 European Pat. Off. .
1428353 2/1969 Fed. Rep. of Germany .
2262648 7/1974 Fed. Rep. of Germany .
2506956 8/1975 Fed. Rep. of Germany .
3005238 8/1981 Fed. Rep. of Germany .
3605235 8/1987 Fed. Rep. of Germany .
1044815 10/1966 United Kingdom ..... 15/83

*Primary Examiner*—Edward L. Roberts
*Attorney, Agent, or Firm*—Evenson, Wands, Edwards, Lenahan & McKeown

[57] ABSTRACT

A sweeping machine having a housing which comprises two housing parts that can be separated from one another. One housing part is used for the bearing of two circular brooms. The other housing part is constructed as a receptacle for sweepings. An arrangement is provided for detachably connecting the two housing parts which has devices for the centering and devices for the locking of the two housing parts. The connecting of the two housing parts requires relatively high expenditures in the state of the art. The two housing parts are lifted manually, are hung into one another and are pressed together. They are then locked in this pressed-together position by means of a locking lever. According to the invention, the devices for the centering comprise an inserting aid by means of which the one housing part can be joined to the other housing part which, in its tilted inoperative position, rests on a floor surface, and the devices for the locking comprise a locking element pivotally connected to one housing part for the pulling-together of the two housing parts into their operative position.

16 Claims, 2 Drawing Sheets

Fig. 1
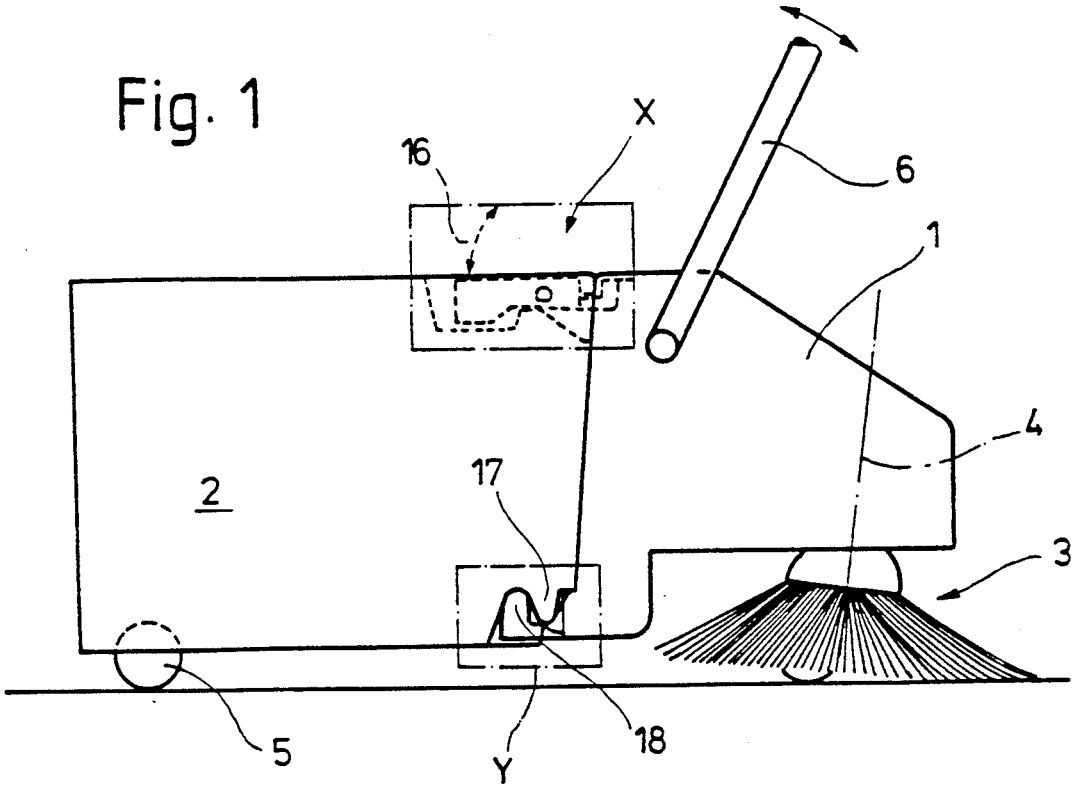
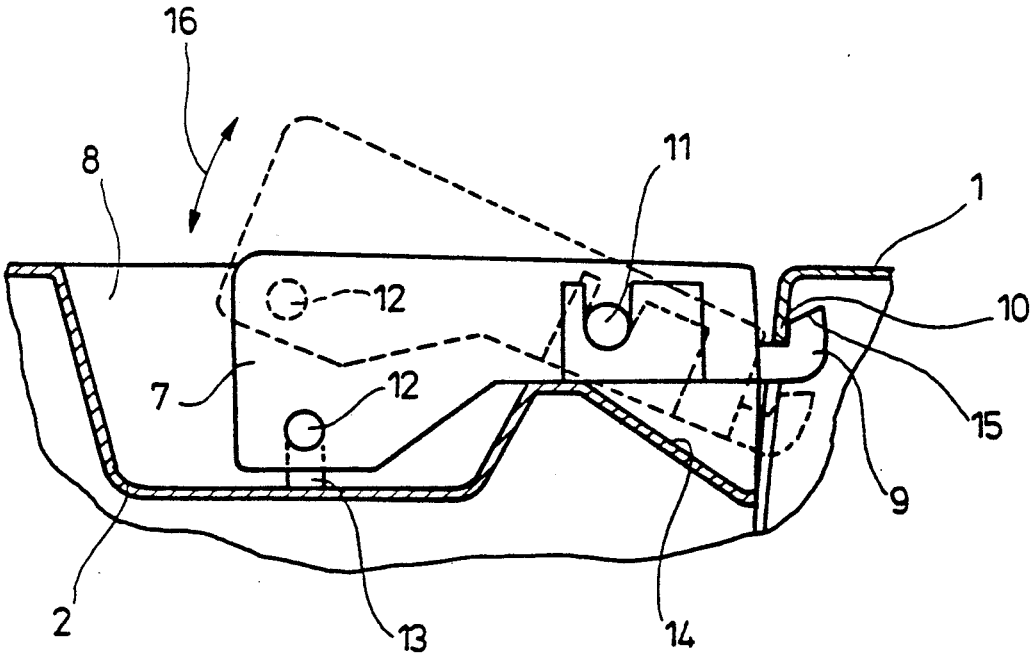
Fig. 2

SWEEPING MACHINE HAVING A HOUSING WHICH COMPRISES TWO SEPARABLE HOUSING PARTS

BACKGROUND AND SUMMARY OF THE INVENTION

This invention relates to a sweeping machine having a housing which comprises two housing parts that can be separated from one another, of which one is used for the bearing of two circular brooms, and the other one is constructed as a receptacle for sweepings. An arrangement is provided for connecting the two housing parts which has devices for the centering and devices for the locking-together of the two housing parts.

A sweeping machine is known (Haaga top Kehrmaschinenkatalog of the firm Haaga Kunststofftechnik GmbH in 7312 Kirchheim/Teck-Ötlingen), whose housing comprises two housing parts, of which the front housing part carries two circular brooms and the rear housing part serves as a receptacle for sweepings. The two housing parts can be separated from one another in order to, for example, empty the receptacle for the sweepings. For a new connection of the two housing parts, the two housing parts are first tilted or lifted manually by an operator so far that the receptacle for the sweepings can be hung into two hooks on the rearward bottom side of the front part. Subsequently, the two housing parts are pressed together by hand on their top side and, by means of a receptacle grip equipped with a locking hook, are locked together in this assembled position.

It is an object of the invention to provide a sweeping machine of the initially mentioned type in which the coupling of the two housing parts can be carried out more easily.

This object is achieved according to referred embodiments of the invention in that the devices for the centering comprise an inserting aid by means of which one housing part can be attached to the other housing part which rests on a floor surface in a tilted rest position, and in that the devices for the locking comprise a locking element pivotally connected to a housing part for the pulling-together of the two housing parts into their operative position.

As a result of this arrangement, it is sufficient for the connecting of the two housing parts to lift only one housing part—such as the receptacle for the sweepings—and to connect it to the other housing part resting on the floor in such a manner that the inserting aid is engaged. By means of the subsequent operating of the locking element, the two housing parts are automatically pulled together and joined correctly without the requirement of having to align the two housing parts manually with respect to one another.

In a development of the invention, the devices for the centering of the two housing parts are arranged in the area of the floor, and the devices for the locking of the two housing parts are arranged in the area of the top side of the housing. As a result of this measure, it is possible to first precenter the two housing parts in a simple manner and then lock them together, for example, by means of a single locking element.

In a further development of the invention, the devices for the centering have hook-shaped profilings which correspond to one another and can be hooked into one another in a joint-like fashion.

In a further development of the invention, at least one profiling is provided with a sliding surface which can be placed on a vertex of the corresponding profiling of the other housing part and points diagonally downward in the direction of this housing part. By means of this diagonal sliding surface, the profiling of the one housing part, after being placed on the vertex of the profiling of the other housing part, slides along the vertex of this profiling into it as soon as the locking element becomes operative and pulls the two housing parts together.

In a further development of the invention, the locking element is pivotally disposed on the one housing part and comprises a locking hook which is applied to a locking edge of the other housing parts from below. In a further development, a stop slope is provided on the top side of the locking hook and rises toward its ends. During the locking movement of the locking element, this stop slope slides along the locking edge of the other housing part until the locking hook completely reaches behind the locking edge. By means of this sliding movement, the two housing parts are pulled together into their operative position from their precentered position.

In a further development, a stop for limiting the swivelling range of the locking element is provided on the housing part to which the locking element is pivotally connected. If the locking element is, for example, situated on the receptacle for the sweepings, the locking element is used at the same time as a grip on which the receptacle for the sweepings can be lifted and carried.

In a further development of the invention, devices are provided for locking the locking element in the operative position locking the two housing parts. This is expedient in order to prevent a detaching of the locking element during the operation.

Other objects, advantages and novel features of the present invention will become apparent from the following detailed description of the invention when considered in conjunction with the accompanying drawings.

BRIEF DESCRIPTION OF THE DRAWINGS

FIG. 1 is a schematic lateral view of an embodiment of a sweeping machine according to the invention, in which, for connecting the two housing parts, these are mutually centered in the area of their bottom by means of centering devices and are then, in the area of their top side, pulled together and locked to one another by means of a locking element indicated by an interrupted line;

FIG. 2 is an enlarged representation of a cutout X of FIG. 1; that is, a locking element according to FIG. 1 which is disposed pivotally on the rear housing part;

DETAILED DESCRIPTION OF THE DRAWINGS

Figure 3:
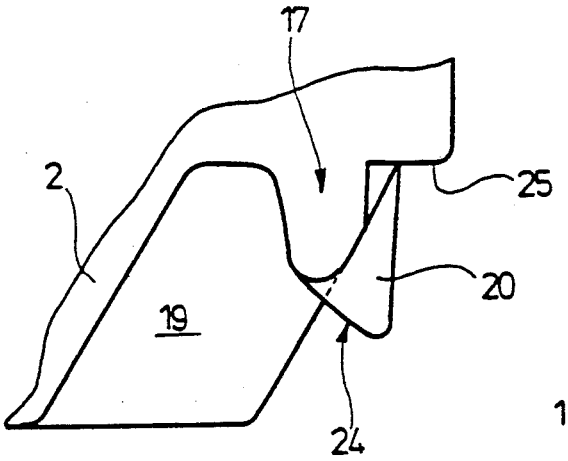
FIG. 3 is a view of the devices for the centering as an enlarged representation of the cutout Y of FIG. 1.

A sweeping machine according to FIG. 1 has a front housing part I which forms the sweeping part which will still be described. In addition, the sweeping machine has a rear housing part 2 which is open in the direction of the front housing part 1 and is used as a receptacle for sweepings. The two housing parts 1, 2 each are self-supporting constructions which are directly connected with one another; that is, they are not inserted into a common frame.

The front housing part 1 is provided with two circular brooms 3 rotating toward the inside, the axes of rotation 4 of which are sloped respectively in such a manner to the perpendicular line that the circular brooms 3 in their front area sweep over and sweep the floor. The circular brooms 3 are driven by rolls which are arranged on the inside of their bristle rings, rest on the floor and are only outlined in FIG. 1. The circular brooms 3 sweep sweepings located on the floor toward the inside to a sweeping lip which is mounted on a receiving plate. The receiving plate extends to the rear housing part 2 serving as the receptacle for sweepings so that the sweepings swept onto the sweeping lip are guided toward the rear into the receptacle for the sweepings. In its rear area, the housing part 2 is provided with a runner 5 which permits a simple pushing of the sweeping machine. For the pushing of the sweeping machine by an operator, a yoke-type pushing handle 6 is provided which is pivotally arranged on the front housing part I. Both housing parts 1 and 2 are made of plastic. The construction and method of operation of the sweeping drive as well as of the receiving plate for the receiving and conveying of the sweepings into the receptacle for the sweepings are described in detail in the German Patent Document DE-PS 22 62 648 as well as in the German Patent Document DE-OS 36 05 235, so that they do not have to be discussed further at this point.

In order to permit the emptying of the receptacle for the sweepings, that is of the rear housing part 2, in a simple manner, the whole rear housing part 2 is separated from the front housing part 1 so that this housing part 2 can be carried away separately and can be emptied. I order to connect the housing parts 1 and 2 with one another and to ensure a perfect locking during the operation, a device is provided in the area of the connecting corresponding facing sides of the two housing parts 1 and 2 which connects the two housing parts I, 2 in the operative condition with one another in such a manner that a rigid unit is obtained.

Figure 4:
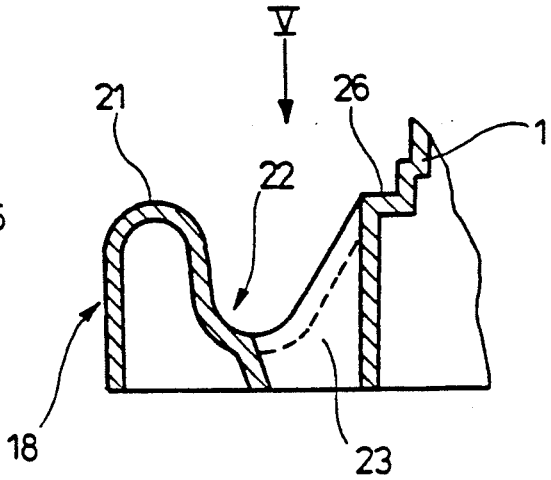
FIG. 4, also as an enlarged representation of the cutout Y according to FIG. 1, is a view of the hooked-shaped profiling of the front housing part which corresponds to FIG. 3 and into which the profiling of the rear housing part can be hung, in which case the profiling is illustrated as a sectional view along Line IV—IV of FIG. 5.
Figure 5:
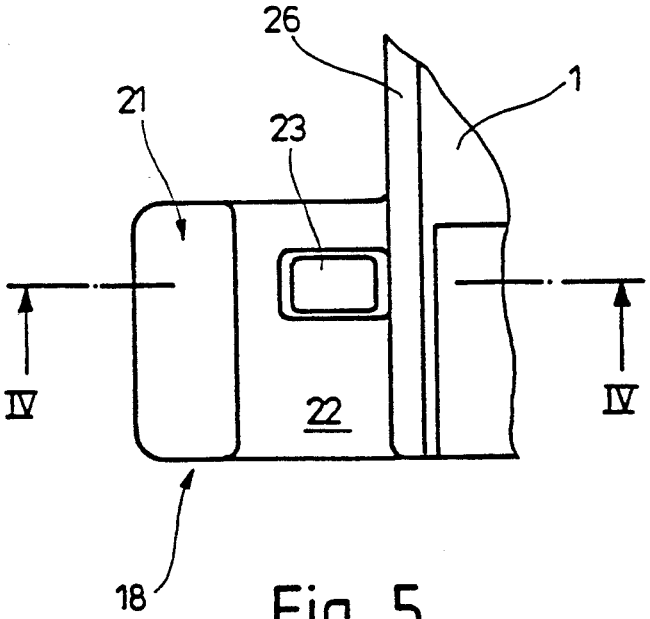
FIG. 5 is a top view in the direction of the arrow V of FIG. 4 of the right hook-shaped profiling viewed in the direction of the front of the housing part.

The arrangement for connecting the two housing parts 1 and 2 comprises devices for the centering as well as devices for the locking of the two housing parts I and 2. In the embodiment according to FIGS. 1 to 5, the devices for the centering are situated in the area of the housing bottom of the two housing parts I and 2. The devices for the locking are arranged in the area of the top side of the two housing parts 1 and 2. In FIG. 1, the devices for the locking as well as the devices for the centering are only schematically represented in the cutouts (X) and (Y). For the following detailed description, reference is therefore made to FIGS. 3 to 5 with respect to the devices for the centering, and to FIG. 2 with respect to the devices for the locking of the two housing parts 1 and 2.

When the two housing parts 1 and 2 are separated from one another, the front housing part 1 rests in its inoperative position on the floor while it is tilted to the rear because it is supported on the floor by means of its driving rolls arranged inside the circular broom 3 as well as by means of the rearward bottom edge of its housing floor. The devices for the centering have on the front housing part I, in the area of its housing bottom on both sides, one hook-shaped profiling 18 respectively which projects toward the rear. The two lateral profilings 18 of the front housing part 1 are constructed symmetrically so that in the following only the profiling 18 is described which is on the right in the driving direction.

This profiling 18 is provided with an upwardly projecting projection which has a vertex 21 and which is followed in the direction of the circular brooms 3 by a groove-shaped indentation 22 for the receiving of a projection 17 of the pertaining profiling of the rear housing part 2 which will still be described. Furthermore, in this indentation 22, a recess 23 is provided which has an approximately four-cornered cross-section and which is used for receiving a projection 20 of the corresponding profiling of the rear housing part 2 which will also be described. The profiling 18 of the front housing part 1 projects so far toward the rear in the direction of the rear housing part 2 that the profiling of the rear housing part 2, in a manner that will be described in detail, can be placed on the vertex of the pin of the profiling 18 without the requirement of having to lift the front housing part 1. In order to connect the two housing parts 1 and 2 with one another, it is therefore sufficient to lift the rear housing part 2 and to place it against the tilted front housing part 1 which is in the inoperative position.

Corresponding to the two lateral profilings of the front housing part 1, two profilings, which are arranged laterally in the area of the housing bottom, are also provided on the rear housing part 2. In this case also, only the right profiling will be described in a representative manner since the left profiling is constructed identically. The profiling of the rear housing part 2 has a projection 17 which projects downward and to which a bulging-out 19 is connected toward the rear in the direction of the runner 5, for the accommodation of the projection of the profiling 18 of the front housing part 1. On the projection 17, a lengthening 20 is provided which extends toward the front in a wedge shape and which is provided with a sliding surface 24 which extends diagonally downward and toward the front. In the direction of its front side and connecting to the projection 17, the rear housing part 2 has a bearing border 25 which, in the assembled operative position of the two housing parts 1 and 2, rests on a bearing surface 26 of the housing part 1.

In order to now connect the two housing parts 1 and 2 with one another, housing part 2 is first placed against the tilted housing part 1 resting on the floor surface. This takes place in that the housing part 2 is manually positioned on the housing part 1 such that, on each side, the sliding surface 24 of the lengthening 20 used as an inserting aid is placed on the vertex 21 of the respective projection of the profilings 18 of the front housing part 1. For this purpose, the profilings of the front or those of the rear housing part 1 and 2 must project so far in the direction of the respective other housing part that the profilings of the rear housing part 2 can be placed on the profilings is of the front housing part 1 which is in the inoperative position. Should, during the connecting and centering of the rear housing part 2, the upper edges of the two housing parts 1 and 2 come in contact before the corresponding profilings arrive in a mutually precentered engagement, a connecting of the rear housing part 2 will not be possible.

In the embodiment according to FIGS. 1 to 5, the lengthening 20 of the profiling of the rear housing part 2 are pulled so far toward the front that, during a connecting, the sliding surface 24 definitely comes to rest on the vertex 21 before the upper edges of the two housing parts 1 and 2 touch one another.

In this position, the housing part 2 is precentered on housing part 1. In order to bring the two housing parts 1 and 2 from this position into their operative position, where they are rigidly connected with one another, it is sufficient to operate the locking element pivotally connected to the top side of the rear housing part 2. As a result of the operation of this locking element which will be described in the following and which locking element will be called a swivel grip 7 in the following, the profilings of the rear housing part 2 slide along the sliding surfaces 24 on the projections of the profiling 18 of the front housing part 1 into the respective indentation 22. In this position, the hook-shaped profilings of the two housing parts 1 and 2 are hooked into one another in a joint-type manner.

The swivel grip 7 is disposed so that it can be swivelled about a horizontal axis Il and forms a lever which, on its end directed toward the housing part 1, is provided with an upwardly projecting locking hook 9 and, on its rear-side end is equipped with a handle for an operator. The upwardly projecting locking hook 9 of the swivel grip 7 is provided on its top side with a stop slope 15 which slopes down in the direction of the axis 11 of the swivel grip 7. On the front housing part 1, the housing wall on the front face is pulled downward in such a manner that it forms a downward projecting locking edge 10.

The swivel grip 7 is arranged in a recess 8 in the top side of the rear housing part 2. The recess 8 is situated in the center of the housing part 2 and extends to the front face of the housing part 2. Behind the swivel grip 7, the recess 8 has sufficient space in order to permit the reaching-in of a hand for the lifting of the swivel grip 7. The bottom of the recess 8 extends at the level of the axis 11 to the front face in a slope 14 in the downward direction , the slope forming a stop for the bounding of the swivel range of the swivel grip 7. As soon as the swivel grip 7 is therefore lifted so far that it comes to rest on the slope 14, it can be used as a carrying grip by an operator.

The swivel grip 7 is supportably disposed by means of two mutually opposite journals and can be swivelled about a horizontal axis 11 in the housing part 2 in the direction of the double arrow 16. On both sides of the handle of the swivel grip 8, cams 12 are molded on which, in the closed position of the swivel grip 7, engage in corresponding recesses 13 of the housing part 2. As a result, the swivel grip 7 is locked in this position.

In the position, in which the two housing parts 1 and 2 are precentered by a placing of the sliding surface 24 on the vertexes 21, the swivel grip 7 is in its open position resting against the slope 14. In this position, the two housing parts are displaced with respect to the height and rest against one another in the area of their top side, in which case the top edge of the rear housing part 2 is situated above that of the front housing part 1. As soon as an operator manually presses the swivel grip 7 downward, the locking hook 9 moves upward. As a result, its stop slope 15 comes to rest on the bottom side of the locking edge 10 and exercises a force against it. As a result of this force, the lengthenings 20 slide along their sliding surfaces 24 into the indentations 22 and farther into the recesses 23 so that the already described joint of the profilings is formed in the area of the housing bottom. The two housinq parts 1 and 2 are aligned with respect to one another. The stop slope 15 slides along the locking edge 10 until the locking hook 9 reaches behind the locking edge 10 and the swivel grip 7 is situated in its closed and locked position. In order to obtain a certain tension and thus prevent an opening-up of the connection of the two housing parts 1 and 2 during the operation, the housing wall of housinq part 1 in the area of the locking edge 10 is elastically deformable in a certain area. The two housing parts 1 and 2 are therefore automatically pulled together by the movement of the swivel grip 7.

In another embodiment, for an elastic bracing of the two housing parts 1 and 2 in the operative condition, elastic sealing devices are mounted in the area of the front face of at least one of the two housing parts I and 2 and also generate an elastic bracing of the housing parts 1, 2.

In order to separate the two housing parts 1 and 2 from one another, the operation takes place in reverse order. First, the swivel grip 7 is lifted which releases the locking on the top side of the two housing parts 1 and 2. Then the housing part 2 is simply lifted on this swivel grip 7, thereby automatically unhinging the profilings in the in the area of the housing bottom. Now the rear housing part 2 can be carried away.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A sweeping machine comprising, a first housing part for housing a plurality of circular rotatable sweeping brooms operable to sweep a floor surface, a second housing part for housing a receptacle for sweepings from the brooms, locking apparatus for detachably locking the first and second housing parts to one another and, centering apparatus for centering the first and second housing parts with respect to one another when the housing parts are locked to one another, wherein the centering apparatus includes an inserting aid by means of which one housing part can be joined to the other housing part with one of the housing parts in a tilted inoperative position resting on a floor surface, and wherein the locking apparatus includes a locking element which is pivotally connected to one of the housing parts and is operable to pull the two housing parts together into their operative position upon pivotal locking movement of the locking element.

2. A sweepi· ; machine according to claim 1, wherein the centering apparatus of the two housing parts is arranged in use in the area of the floor surface to be swept at a bottom side of the housing parts, and wherein the locking apparatus is arranged in the area of a top side of the housing parts. k

3. A sweeping machine according to claim 2, wherein the centering apparatus inserting aid includes hook-shaped profilings which can be hung into one another in the manner of a joint.

4. A sweeping machine according to claim 3, wherein at least one of the profilings at one housing part is provided with a sliding surface which can be placed on a vertex of a profiling of the other housing part and points downward in the direction of other housing part.

5. A sweeping machine according to claim 4, wherein the at least one profiling at the one housing part is provided with a lengthening which, in the operative position of the two housing parts, engages in a recess of the corresponding profiling of the other housing part.

6. A sweeping machine according to claim 2, wherein the locking element is pivotally disposed on the one housing part and comprises a locking hook which reaches from the bottom, behind a locking edge of the other housing part.

7. A sweeping machine according to claim 6, wherein a stop slope is provided which rises o the top side of the locking hook in the direction of its end.

8. A sweeping machine according to claim 7, wherein a stop is provided on the housing part to which the locking element is pivotally connected, said stop bounding the swivel area of the locking element.

9. A sweeping machine according to claim 8, wherein devices are provided for locking the locking element in the operative position which locks the two housing parts together.

10. A sweeping machine according to claim 1, wherein the centering apparatus inserting aid includes hook-shaped profilings which can be hung into one another in the manner of a joint.

11. A sweeping machine according to claim 10, wherein at least one of the profilings at one housing part is provided with a sliding surface which can be placed on a vertex of a profiling of the other housing part and points downward in the direction of other housing part.

12. A sweeping machine according to claim 11, wherein the at least one profiling at the one housing part is provided with a lengthening which, in the operative position of the two housing parts, engages in a recess of the corresponding profiling of the other housing part.

13. A sweeping machine according to claim 1, wherein the locking element is pivotally disposed on the one housing part and comprises a locking hook which reaches from the bottom, behind a locking edge of the other housing part.

14. A sweeping machine according to claim 13, wherein a stop slope is provided which rises on the top side of the locking hook in the direction of its end.

15. A sweeping machine according to claim 13, wherein a stop is provided on the housing part to which the locking element is pivotally connected, said stop bounding the swivel area of the locking element.

16. A sweeping machine according to claim 13 wherein devices are provided for locking the locking element in the operative position which locks the two housing parts together.

* * * * *